United States Patent [19]

Filter et al.

[11] 4,405,512

[45] Sep. 20, 1983

[54] PROCESS FOR ENCAPSULATING RADIOACTIVE ORGANIC LIQUIDS IN A RESIN

[75] Inventors: Harold E. Filter; Stevens S. Drake, both of Midland, Mich.

[73] Assignee: The Dow Chemical Company, Midland, Mich.

[21] Appl. No.: 212,474

[22] Filed: Dec. 3, 1980

Related U.S. Application Data

[63] Continuation of Ser. No. 32,992, Apr. 25, 1979, abandoned.

[51] Int. Cl.[3] ..... G21F 9/16

[52] U.S. Cl. ..... 252/628; 252/631; 264/0.5

[58] Field of Search ..... 252/628, 631; 264/0.5

[56] References Cited

U.S. PATENT DOCUMENTS

| | | | |
|---|---|---|---|
| 3,256,219 | 7/1966 | Will | 521/62 |
| 3,463,738 | 8/1969 | Fitzgerald et al. | 252/628 |
| 4,009,116 | 2/1977 | Bähr et al. | 252/628 |
| 4,077,901 | 3/1978 | Arnold et al. | 252/628 |
| 4,131,563 | 12/1978 | Bähr et al. | 252/628 |

*Primary Examiner*—Leland A. Sebastian

*Attorney, Agent, or Firm*—A. R. Lindstrom

[57] ABSTRACT

A cured resin system is used to encapsulate certain liquid low level radioactive wastes which are solvents for or are soluble in the uncured resin and which are more soluble in water than in the uncured resin. The process comprises the dilution of said waste with water to an extent that the amount of waste that will partition in the uncured resin system is less than the amount that will retard the cure rate of the system or that will adversely affect physical properties of the cured product, followed by the uniform dispersion of the aqueous solution in said curable resin system after which the resin system is cured to a solid with the aqueous waste solution dispersed therein.

8 Claims, No Drawings

PROCESS FOR ENCAPSULATING RADIOACTIVE ORGANIC LIQUIDS IN A RESIN

This is a continuation of application Ser. No. 32,992, filed Apr. 25, 1979, now abandoned.

BACKGROUND OF THE INVENTION

Among the many problems associated with the utilization of radioactive materials is the disposal of the waste material. The prior techniques for such disposal included the encapsulation of the waste in a solid and the burial of that solid in designated sites. Both concrete and urea/formaldehyde resins have been so used. More recently it has been proposed that such wastes in solid form, aqueous solutions or slurries can be dispersed in unsaturated polyesters or vinyl ester resins and converted to a solid with droplets of the liquid dispersed therein.

Each of the prior techniques are useful with the aqueous wastes resulting from nuclear power plant operation. However, those techniques have severe shortcomings when attempts are made to use them with the radioactive organic solvent wastes from nuclear power plants and also those wastes emanating from chemical and medical laboratories. Such wastes are sometimes water soluble and may also be soluble in the resin system or may be a solvent for the resin system or parts thereof. Typical of such wastes are acetone rinses from tracer studies.

The prior techniques for encapsulating liquid radioactive wastes involved forming a waste in resin emulsion followed by curing the resin. When the waste is soluble in the resin or is a solvent therefor, formation of the emulsion may be precluded and/or the waste may cause a retardation of the time to gel the system and consequently for the system to cure. Also, such soluble wastes can adversely affect the physical properties of the cured product. These undesirable effects cannot be abided with the strict regulations surrounding radioactive waste disposal.

SUMMARY OF THE INVENTION

The process of this invention provides a means for encapsulating certain wastes in a cured resin when those wastes have solubility characteristics to make their encapsulation by prior techniques impractical. The process involves the aqueous dilution of the waste to an extent where the prior techniques are operable.

DESCRIPTION OF THE INVENTION

Those low level radioactive wastes for which the present process is useful include those which are solvents for or are soluble in the uncured resins used for the encapsulation. The wastes also have greater solubility in water than in the uncured resin. Typical of such wastes are acetone, the lower alcohols, such as methyl and ethyl alcohol, the glycols such as ethylene glycol, the monoethers of glycols such as the methyl ether of ethylene glycol and the alkanolamines such as ethanolamine.

The waste may also contain solids, such as filter aids, ion exchange beads and the like, or other liquids such as water-insoluble organic liquids or minor amounts of water. Although these entities by themselves could be encapsulated by the prior techniques, the presence of significant amounts of the water soluble, resin soluble waste liquids, as defined above, in mixtures containing such entities cannot be encapsulated by those techniques in a practical manner.

Such wastes are commonly generated from work in medical institutions, chemical laboratories or similar organizations. Frequently, such wastes are multicomponent mixtures involving a variety of miscible or immiscible liquids or solids. Responsible practice will dictate that at least qualitative screening of the waste with small verification experiments will be conducted prior to full scale operations.

The resin useful as the encapsulant may be a vinyl ester resin, an unsaturated polyester or a mixture of a vinyl ester resin and an unsaturated polyester.

Vinyl ester resins are described in U.S. Pat. No. 3,367,992 wherein dicarboxylic acid half esters of hydroxyalkyl acrylates or methacrylates are reacted with polyepoxide resins. Bowen in U.S. Pat. Nos. 3,066,112 and 3,179,623 describes the preparation of vinyl ester resins from monocarboxylic acids such as acrylic and methacrylic acid. Bowen also describes alternate methods of preparation wherein a glycidyl methacrylate or acrylate is reacted with the sodium salt of a dihydric phenol such as bisphenol A. Vinyl ester resins based on epoxy novolac resins are described in U.S. Pat. No. 3,301,743 to Fekete et al. Fekete et al. also describe in U.S. Pat. No. 3,256,226 vinyl ester resins wherein the molecular weight of the polyepoxide is increased by reacting a dicarboxylic acid with the polyepoxide resin as well as acrylic acid, etc. Other difunctional compounds containing a group which is reactive with an epoxide group, such as an amine, mercaptan and the like may be utilized in place of the dicarboxylic acid. All of the above-described resins, which contain the characteristic linkages:

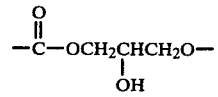

and terminal, polymerizable vinylidene groups, are classified as vinyl ester resins, and are incorporated herein by reference.

Briefly, any of the known polyepoxides may be employed in the preparation of the vinyl ester resins of this invention. Useful polyepoxides are glycidyl polyethers of both polyhydric alcohols and polyhydric phenols, epoxy novolacs, epoxidized fatty acids or drying oil acids, epoxidized diolefins, epoxidized di-unsaturated acid esters as well as epoxidized unsaturated polyesters, so long as they contain more than one oxirane group per molecule.

Preferred polyepoxides are glycidyl polyethers of polyhydric alcohols or polyhydric phenols having weights per epoxide group of about 150 to 2000. These polyepoxides are usually made by reacting at least about two moles of an epihalohydrin or glycerol dihalohydrin with one mole of the polyhydric alcohol or polyhydric phenol, and a sufficient amount of a caustic alkali to combine with the halogen of the halohydrin. The products are characterized by the presence of more than one epoxide group per molecule, i.e., a 1,2-epoxy equivalency greater than one.

Unsaturated monocarboxylic acids include acrylic acid, methacrylic acid, halogenated acrylic or methacrylic acid, cinnamic acid and the like and mixtures thereof. Also included within the term "unsaturated carboxylic acids" are the hydroxyalkyl acrylate or methacrylate half esters of dicarboxyl acids as described in U.S. Pat. No. 3,367,992 wherein the hydroxyalkyl group preferably has from 2 to 6 carbon atoms.

Preferably, the thermosettable resin phase comprises the vinyl ester or polyester resin and a copolymerizable monomer. Suitable monomers must be essentially water insoluble to maintain the monomer in the resin phase in the emulsion, although complete water insolubility is not required and a small amount of monomer dissolved in the emulsified water does no harm.

Suitable monomers include vinyl aromatic compounds such as styrene, vinyltoluene, divinylbenzene and the like. Other useful monomers include the esters of saturated alcohols such as methyl, ethyl, isopropyl, octyl, etc., with acrylic acid or methacrylic acid, hydroxyethyl or hydroxypropyl acrylate or methacrylate, vinyl acetate, diallyl maleate, dimethallyl fumarate; mixtures of the same and all other monomers which are capable of copolymerizing with the vinyl ester resin and are essentially water insoluble.

Another embodiment of this invention utilizes a modified vinyl ester resin wherein about 0.1 to 0.6 mole of a dicarboxylic acid anhydride per equivalent of hydroxyl is reacted with the vinyl ester resin. The shelf stability of the water-in-resin emulsion prepared from said modified vinyl ester resin is somewhat less, comparatively, than that found with the unmodified vinyl ester resins, yet the stability is significantly improved over the art. Both saturated and unsaturated acid anhydrides are useful in said modification.

Suitable dicarboxylic acid anhydrides containing ethylenic unsaturation include maleic anhydride, the citraconic anhydride, itaconic anhydride and the like and mixtures thereof. Saturated dicarboxylic acid anhydrides include phthalic anhydride, anhydrides of aliphatic unsaturated dicarboxylic acid and the like. The modified vinyl ester resin is utilized in this invention in the same manner as already described for the unmodified vinyl ester resin.

A wide variety of unsaturated polyesters which are readily available or can be prepared by methods well known to the art may also be utilized in the method. Such polyesters result from the condensation of polybasic carboxylic acids and compounds having several hydroxyl groups. Generally, in the preparation of suitable polyesters, an ethylenically unsaturated dicarboxylic acid such as maleic acid, fumaric acid, itaconic acid or the like is esterified with an alkylene glycol or polyalkylene glycol having a molecular weight of up to 2000 or thereabouts. Frequently, dicarboxylic acids free of ethylenic unsaturation such as phthalic acid, isophthalic acid, adipic acid, succinic acid and the like may be employed within a molar range of 0.25 to as much as 15 moles per mole of the unsaturated dicarboxylic acid. It will be understood that the appropriate acid anhydrides when they exist may be used and usually are preferred when available.

The glycol or polyhydric alcohol component of the polyester is usually stoiciometric or in slight excess with respect to the sum of the acids. The excess of polyhydric alcohol seldom will exceed 20 to 25 percent and usually is about 10 to 15 percent.

These unsaturated polyesters may be generally prepared by heating a mixture of the polyhydric alcohol with the dicarboxylic acid or anhydride in the proper molar proportions at elevated temperatures, usually at about 150° to 225° C. for a period of time ranging from about 1 to 5 hours.

Polymerization inhibitors such as t-butyl catechol may be advantageously added. It is also possible to prepare unsaturated polyesters directly from the appropriate oxide rather than the glycol, e.g., propylene oxide may be used in place of propylene glycol. Generally, the condensation (polymerization) reaction is continued until the acid content drops to about 2 to 12 percent (—COOH) and preferably from 4 to 8 percent.

Yet, another embodiment of this invention utilizes a vinyl ester/unsaturated polyester resin composition. The composition may be prepared either by physically mixing the two resins in the desired weight proportions or by preparing said vinyl ester resin in the presence of said unsaturated polyester.

In practice of the invention, the liquid radioactive waste is diluted with water to an extent that, when the diluted waste is mixed with the uncured resin, the amount of waste that distributes or partitions in the resin phase is insufficient to retard the cure rate of the resin or to affect adversely the properties of the cured resin. That amount will vary with the nature of the waste and of the resin. The ratio of concentration of waste in the resin and water phases can be readily calculated from the partition coefficient which may be known or easily determined by empirical methods. Alternatively, routine experiments making up the verification procedures will clearly demonstrate the minimum dilution necessary to assure that the benefits of the invention are attained.

Although in theory there is no limit to the maximum dilution, economic considerations will dictate that the minimum dilution is most practical and economical. That follows since the amount of waste to be encapsulated (aqueous solution plus any other insolubles) in the resin by dispersion therein has a practical limit. As a general rule, a ratio of about 3 parts by volume of total waste including water to each part by volume of resin is the maximum that can have a controlled reaction, will provide dispersion integrity, will reliably contain the reactivity for the necessary long storage times and is economically practical.

The aqueous solution together with any insoluble waste is uniformly dispersed in the liquid curable resin. It is preferred that the dispersion be as uniform as possible so that the radioactivity will be uniformly distributed and hot spots avoided. To this end, if there are immiscible liquids or insoluble solids in the waste, the diluted waste should be thoroughly mixed prior to dispersion in the resin.

The dispersion should have sufficient storage stability to last at least through the initial gelation of the resin. The dispersions made with vinyl ester resins, particularly those within the previously described monomer proportions, generally exhibit adequate stability without added emulsifier. Dispersions in unsaturated polyesters frequently will require added emulsifiers to have that stability. Such emulsifiers are known in the art and judicious selection to obtain a closed cell system can be made with simple routine experiments. In many instances, especially with carboxyl terminated polyesters, the sodium carboxylate salt may permit emulsification of the waste without added emulsifier.

Catalysts that may be used for the curing or polymerization are preferably the peroxide and hydroperoxide catalysts such as benzoyl peroxide, lauroyl peroxide, cumene hydroperoxide, t-butyl hydroperoxide, methyl ethyl ketone peroxide, t-butyl perbenzoate, potassium persulfate and the like. The amount of the catalyst added will vary but preferably will be at least 0.1 percent by weight of the resin phase.

Preferably, the cure of the dispersion can be initiated at room temperature by the addition of known accelerating agents or promoters, such as cobalt naphthenate, N,N-dimethyl aniline, N,N-dimethyl-p-toluidine, vanadium neodecanoate and the like usually in concentrations ranging from about 0.01 to 5 weight percent. Alternatively, the catalyst can be added to the resin before dispersing the waste with the promoter added later after formation of the dispersions. The promoted dispersion can be readily cured to at least a gel state in a short period of time as, for example, in about 3 to 30 minutes, and to a solid state in 30 minutes to one or two hours, depending on the temperature, the catalyst level and the promoter level. Cure of the dispersion can also be initiated by heating to a temperature of below 100° C. or the boiling point of the organic liquid, whichever is lower. The common practice of post curing thermoset articles at elevated temperatures for varying periods of time may be utilized with this invention.

The conditions of selection of catalyst, catalyst concentration and promoter selection and concentration must be such that the temperature of the exotherm does not exceed the limits stated above at least until the resin has cured to the extent where is has the strength to withstand the increased vapor pressure if the temperature should rise above those limits. If the temperature exceeds 100° C. prior to that state of cure, the water in the liquid waste will boil which may cause waste material to be released or the organic liquid may be released from the swollen particles.

The solidification may be carried out in any suitable vessel such as a 55 gallon drum. Larger or smaller vessels may be used depending on the amount of waste to be disposed of, on the equipment available and on the limitations of handling and transportation stock. As the size of the vessel is increased, the control of the exotherm becomes more difficult to maintain within the aforementioned limits. In such cases, it may be desirable to adjust the amount of water and the catalyst concentration and promoter for that control.

The process of the invention is illustrated in the following examples wherein all parts and percentages are by weight unless otherwise indicated.

EXAMPLE 1

Various laboratory wastes containing benzene, pyridine, acetone and water were encapsulated. The radioactive components were Carbon 14 and tritium.

A sample of the mixed wastes (hereinafter called the composite) was placed in a bottle and allowed to phase separate into 80 millimeters aqueous layer and a 16 millimeter water-insoluble organic layer.

Enough imbiber beads were added to absorb the water-insoluble layer.

Seventy-five milliliters of the mixed waste (including the swollen beads) were slowly added with agitation to form an emulsion in 50 grams of a vinyl ester resin containing 36 weight percent styrene. The vinyl ester resin employed was the reaction product of equivalent amounts of acrylic acid and a mixture of the diglycidyl ether of bisphenol A (E.E.W. = 188) and an epoxy novolac (E.E.W. = 180). Two and one-half parts per hundred parts resin of benzoyl peroxide as a 40 percent emulsion in isobutyl phthalate (Cadox 40E) was used as a catalyst and 0.1 part per hundred parts of resin of dimethyl toluidine was added as a promoter. The mass gelled in 15 minutes.

The mixed waste (including the swollen beads) was diluted 1 to 1 with water and 75 milliliters given the identical treatment as above. The mass gelled in 7.5 minutes.

EXAMPLE 2

To 50 grams of the vinyl ester resin of Example 1 containing 1.25 grams Cadox 40E is slowly added with agitation 75 milliliters of a simulated radioactive water waste containing 25 percent acetone. With the addition of 0.1 milliliter of N,N-dimethyl-p-toluidine a gel time of 5.6 minutes was obtained. After complete cure, the product was a hard, semi-translucent billet.

We claim:

1. A process for encapsulating low level radioactive liquid organic waste in a cured resin into a form suitable for burial wherein said resin is an unsaturated polyester, a vinyl ester resin or a mixture thereof and wherein said waste is a solvent for or is soluble in the uncured resin and is more soluble in water than in the resin, said process comprising the dilution of said waste with water to an extent that the amount of waste that will partition in said uncured resin is less than the amount to retard the cure rate or to adversely affect physical properties of the cured product, followed by the uniform dispersion of the aqueous solution in said curable resin system after which said resin is cured to a solid with said waste dispersed therein.

2. The process claimed in claim 1 wherein the curable resin is a vinyl ester resin which is the polyacrylate ester of a polyepoxide containing a reactive diluent.

3. The process claimed in claim 2 wherein said reactive diluent is styrene.

4. The process claimed in claim 1 wherein the curable resin is a vinyl ester resin which is the polymethacrylate ester of a polyepoxide containing a reactive diluent.

5. The process claimed in claim 2 or 4 wherein said polyepoxide is a polyglycidyl ether.

6. The process claimed in claim 1 wherein said radioactive liquid organic waste contains acetone.

7. The process claimed in claim 6 wherein the acetone is diluted with at least 3 parts by weight water to one part of acetone.

8. The process claimed in claim 1 wherein the curable resin is an unsaturated polyester containing a reactive diluent.

* * * * *

Disclaimer and Dedication 4,405,512.—*Harold E. Filter; Stevens S. Drake*, both of Midland, Mich. PROCESS FOR ENCAPSULATING RADIOACTIVE ORGANIC LIQUIDS IN A RESIN. Patent dated Sept. 20, 1983. Disclaimer and Dedication filed Dec. 18, 1989, by the assignee, The Dow Chemical Company.

Hereby disclaims and dedicates to the Public all claims of said patent.

[*Official Gazette April 10, 1990* ]